US005098088A

United States Patent [19]

Cohen et al.

[11] Patent Number: 5,098,088

[45] Date of Patent: Mar. 24, 1992

[54] EXERCISE MACHINE FOR HANDICAPPED OR DISABLED PERSONS

[76] Inventors: Alan Cohen, 7728 Prospector Pl., Raleigh, N.C. 27615; Robert C. Williams, III, 11309 Derby La., Raleigh, N.C. 27613

[21] Appl. No.: 593,910

[22] Filed: Oct. 9, 1990

[51] Int. Cl.[5] ..... A63B 21/005

[52] U.S. Cl. ..... 272/129; 272/132; 272/134; 128/25 R

[58] Field of Search ..... 272/125, 129, 130, 131, 272/132, 134, 143, 144; 128/25 R

[56] References Cited

U.S. PATENT DOCUMENTS

| | | | |
|---|---|---|---|
| 3,712,613 | 1/1973 | Feather et al. | 272/129 |
| 4,082,267 | 4/1978 | Flavell | 272/129 X |
| 4,235,437 | 11/1980 | Ruis et al. | 272/134 |
| 4,569,518 | 2/1986 | Fulks | 272/129 |
| 4,746,115 | 5/1988 | Lahman | 272/134 X |
| 4,765,315 | 8/1988 | Krukowski | 272/129 X |
| 4,828,257 | 5/1989 | Dyer et al. | 272/129 |
| 4,915,379 | 4/1990 | Sapp | 272/134 |
| 4,934,694 | 6/1990 | McIntosh | 272/129 |
| 4,949,951 | 8/1990 | Deola | 272/134 |

*Primary Examiner*—Robert Bahr

*Attorney, Agent, or Firm*—Rhodes, Coats, Bennett

[57] ABSTRACT

An exercise machine is particularly adapted for use by handicapped persons or other physically limited persons. The exercise machine includes a plurality of exercise mechanisms operable from a single station so that the handicapped person does not have to move between different stations. The plurality of exercise mechanisms are operatively connected to a single brake mechanism to that each exercise mechanism can be independently manipulated. One of the exercise mechanisms includes an overhead bar assembly which is operable as a bench press or as an overhead press.

9 Claims, 7 Drawing Sheets

EXERCISE MACHINE FOR HANDICAPPED OR DISABLED PERSONS

FIELD OF THE INVENTION

The present invention relates generally to exercise machines and more particularly to a single-station exercise machine particularly adapted for use by handicapped persons which includes a plurality of exercise mechanisms operable from a single station.

BACKGROUND OF THE INVENTION

The majority of exercise equipment in use in the United States consists of several different machines to work all major muscle groups in the body. This method of exercise utilizes circuit training principles in which the individual moves from station to station working a different muscle group at each station. Although this form of progressive resistance exercise is fine for able bodied individuals, it is not acceptable to disabled persons in wheel chairs or other physically limited persons.

Exercise machines are known which enable a user to exercise two major muscle groups from a single station. In U.S. Pat. No. 4,505,475, an exercise machine is disclosed having an arm actuating mechanism and a leg actuating mechanism. Both the arm actuated mechanism and leg actuated mechanism are coupled to a weight element for reversibly displacing the weight element. An exercise coupling mechanism is secured to the frame and the weight element in order to couple the arm actuated mechanism for providing a lifting force to the weight element responsive to independent actuation of the leg mechanism or the arm mechanism.

SUMMARY AND OBJECTS OF THE INVENTION

The present invention relates to an exercise machine designed to allow exercising of most major muscle groups from a single station. The exercise machine includes a frame, a plurality of exercise mechanisms mounted on the frame and operable from a single station, and an electronic brake mechanism for providing resistance against displacement of the exercise mechanism by the user. A drive assembly operatively connects the brake mechanism with each of the exercise mechanisms so that the exercise mechanisms can be independently operated. One of the exercise mechanisms incorporated into the present invention is an overhead bar assembly which is operable as either a bench press or an overhead press. The overhead bar assembly includes an overhead bar which is pivotally mounted to the frame. A handle bar frame is pivotally secured to the end of the overhead bar opposite the frame so as to pivot about a substantially horizontal axis. Means are provided for selectively locking the overhead bar in a fixed position relative to the frame while the handle bar frame is free to pivot about the second axis. Means are also provided for selectively locking the handle bar frame in a fixed position relative to the overhead bar while the overhead bar is free to pivot about the first axis. The first and second locking means can be selectively actuated by the user.

Based on the foregoing, it is a primary object of the present invention to provide an exercise machine for handicapped or physically limited persons.

Another object of the present invention is to provide an exercise machine for handicapped or physically limited persons in which all the major muscle groups can be exercised from a single station.

Another object of the present invention is to provide an exercise machine for handicapped or physically limited persons in which a single brake element is used to provide resistance to plurality of independently actuated exercise mechanisms.

Another object of the present invention is to provide an exercise machine which eliminates the need for weight stacks.

Another object of the present invention is to provide an exercise machine which requires only a small space.

Other objects and advantages of the present invention will become apparent and obvious from a study of the following description and the accompanying drawings which are merely illustrative of such invention.

DESCRIPTION OF THE INVENTION

Figure 1:
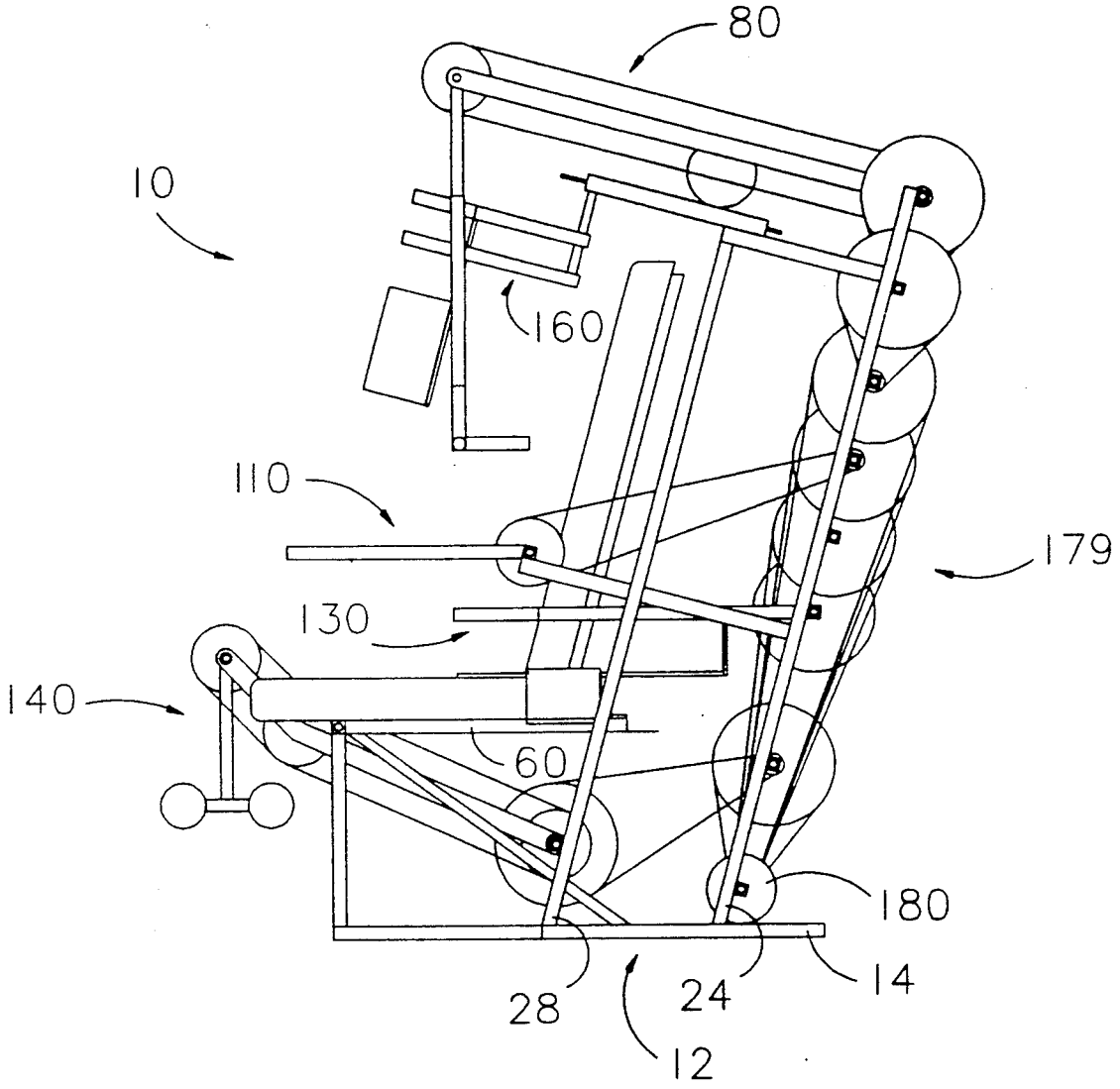
FIG. 1 is a side elevation of the exercise machine of the present invention.
Figure 2:
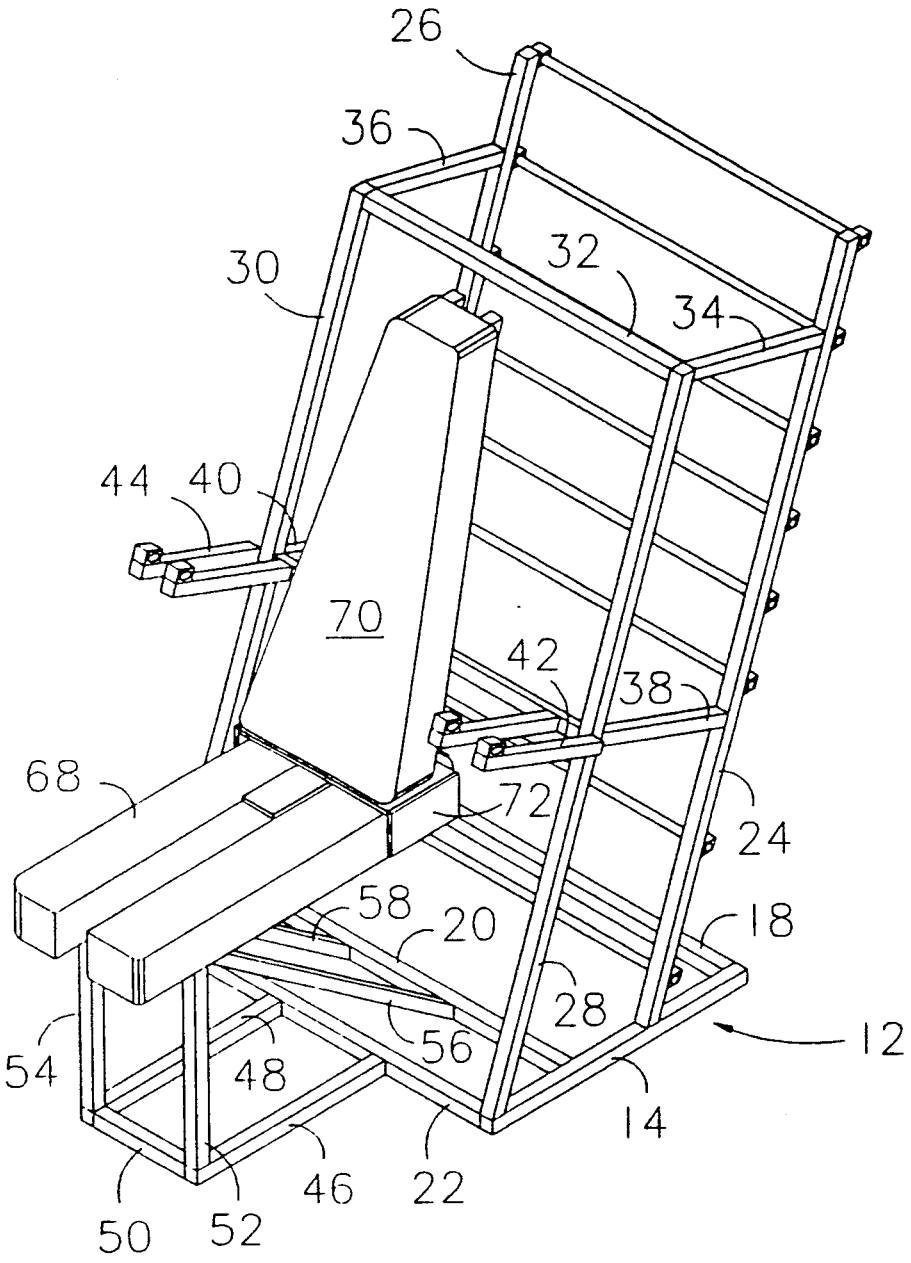
FIG. 2 is a perspective view of the frame of the exercise machine.

Referring now to FIGS. 1-7, there is shown an exercise machine 10 particularly adapted for use by handicapped and infirm persons. In general, the exercise device 10 includes a frame 12, a plurality of user manipulated exercise mechanisms adapted to be contacted and moved by the user, a brake mechanism for providing resistance against movement of the exercise mechanisms; and a drive means for operatively connecting the brake mechanisms to the exercise mechanism so that each exercise mechanism can be independently manipulated to provide exercise for the user.

The frame 12 includes a base comprising a pair of forwardly extending base members 14 and 16 which are laterally spaced from one another. Transversely extending base members 18, 20 and 22 extend between and interconnect the forwardly extending base members 14 and 16.

A pair of rear vertical columns 24 and 26 extend upwardly at an angle from an intermediate point along the forwardly extending base members 14 and 16. Forward vertical columns 28 and 30 also extend upwardly at the same angle from the forward end of the forwardly extending base members 14 and 16. The forward vertical columns 28 and 30 are connected to one another by a cross member 32 which is fixedly secured to the upper ends of the forward vertical columns 28 and 30. The forward vertical columns are also connected to the rear vertical columns 24 and 26 by top members 34 and 36. The top members 34 and 36 extend from the upper end of the forward vertical columns 28 and 30 and join the rear vertical columns 24 and 26 at an intermediate point. Side reinforcing members 38 and 40 extend between and interconnect the forward vertical columns 28 and 30 with the rear vertical columns 24 and 26 approximately midway along the length of the forward vertical columns 28 and 30. Two pairs of support members 42 and 44 extend forwardly at an angle from the forward vertical columns 28 and 30. The support members 42 and 44 are used to support arm curl bars as will be herein after described in greater detail.

The exercise frame 12 further includes a pair of seat frame members 46 and 48 which extend forwardly from member 22. The seat frame members 46 and 48 are interconnected at the forwardmost end by a cross member 50. A pair of seat support columns 52 and 54 extend upwardly from the forward end of the seat frame members 46 and 48. Seat struts 56 and 58 connect the upper end of the seat support columns 52 and 54 to the base member 20 to provide reinforcement for the seat support columns 52 and 54.

A generally U-shaped seat frame 60 is pivotally mounted between the seat support columns 52 and 54. A cylinder (not shown) extends between the intermediate base member 20 and the seat frame 60 for pivoting the frame about a horizontal axis. The bottom pads 68 of the seat are mounted on the seat support frame 60. A back pad 70 is mounted on back rest guide 72 to enable the back rest 70 to slide forwardly and rearwardly along the seat bottom 68. A cylinder (not shown) moves the back rest forwardly and rearwardly.

All of the column and frame members making up the exercise frame 12 may be formed of steel or other similar materials. With the exception of the seat frame 60 which is pivotally mounted between the seat support columns, all of the frame members are fixedly secured by bolting or welding the members together. The particular method chosen for securing the frame members to one another is not critical. Any securement method which provides a rigid frame is sufficient.

The frame 12 supports a plurality of individual exercise mechanisms which can be manipulated from a single station or seat. This aspect of the invention obviates the need to move from station to station in order to exercise the various muscles groups and makes the invention particularly suitable for handicapped or infirm person.

Figure 6:
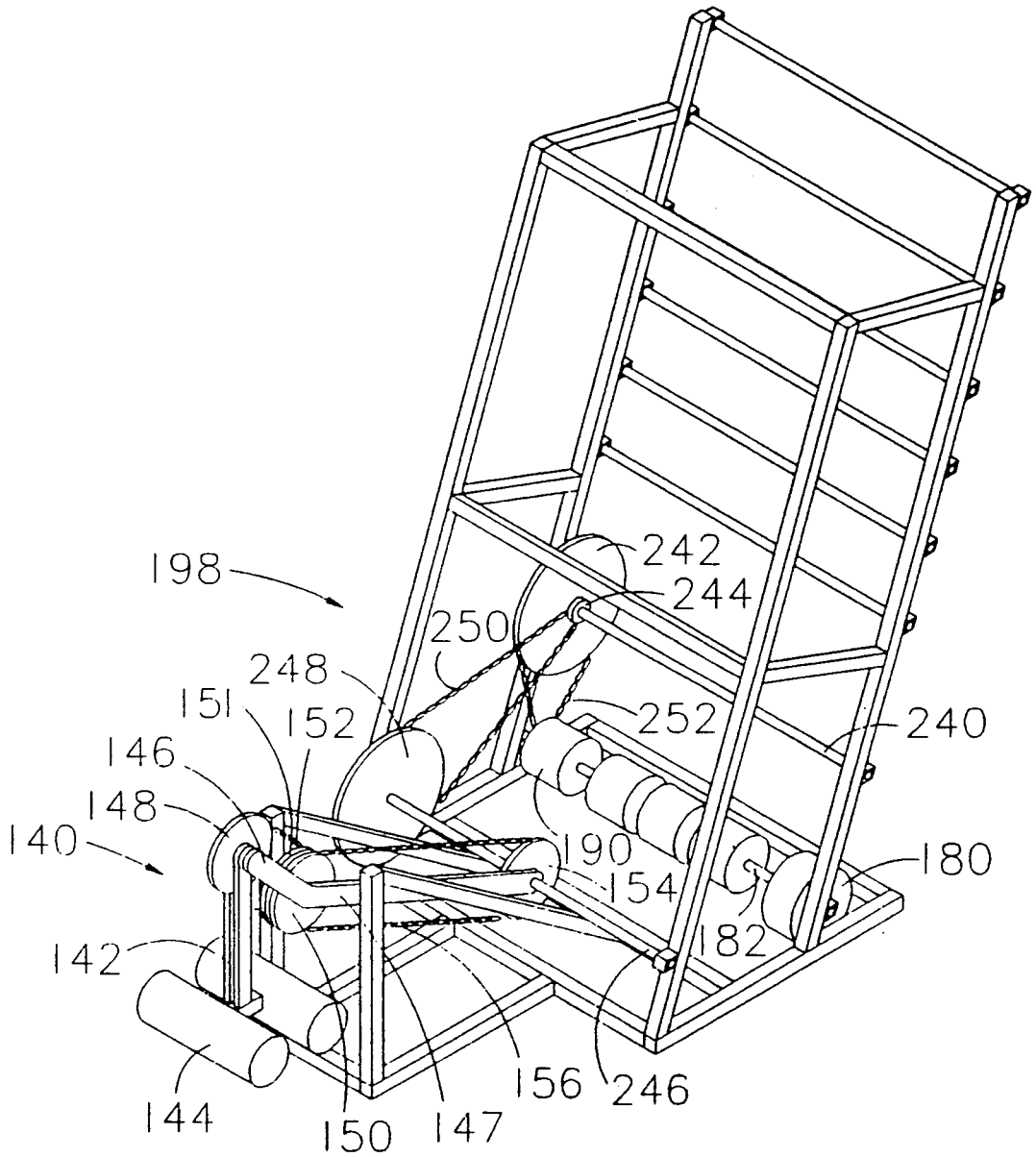
FIG. 6 is a perspective view of the leg curl assembly and its associated drive assembly.
Figure 7:
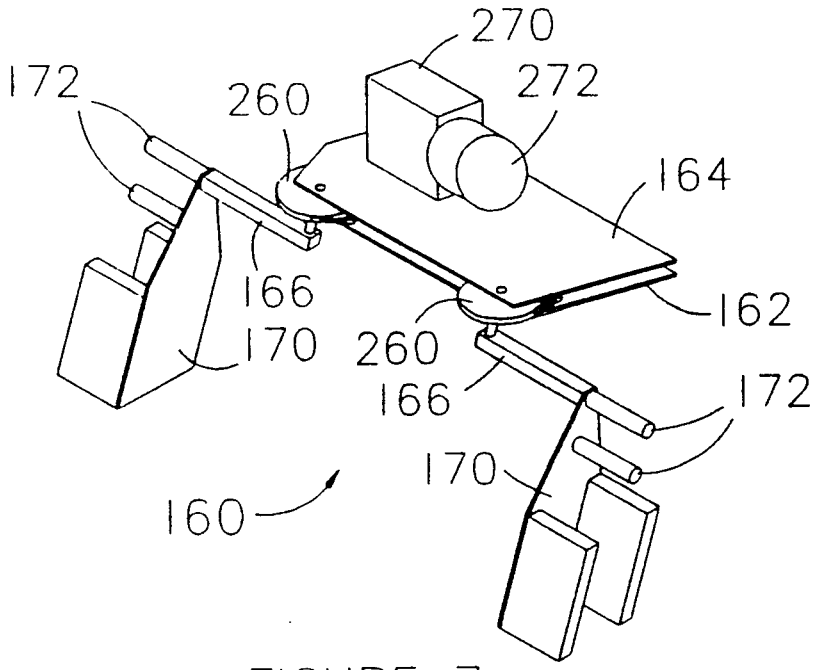
FIG. 7 is a perspective view of the fly assembly.
Figure 7A:
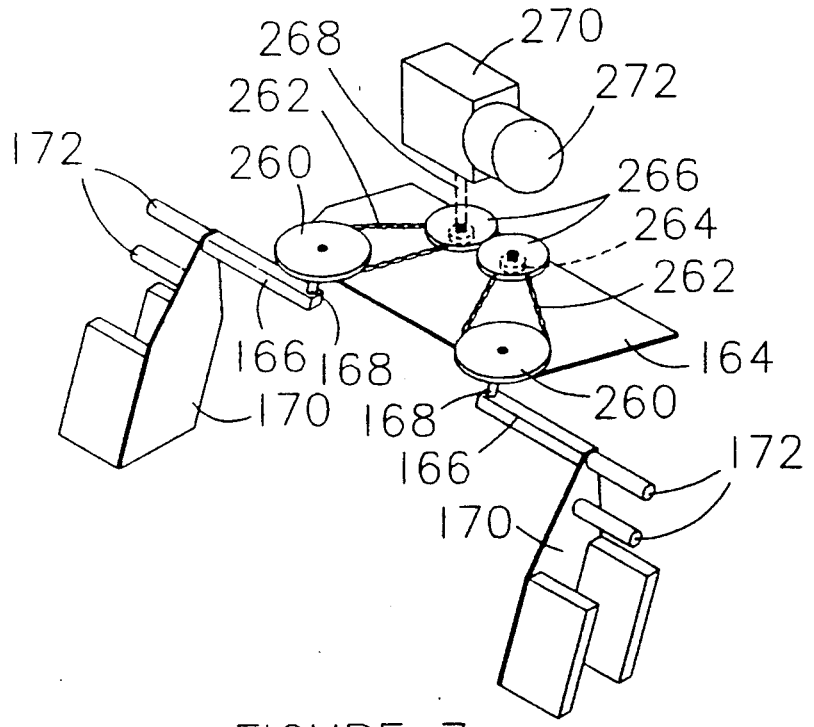
FIG. 7A is a perspective view of the fly assembly with the upper mounted plate removed.

In the illustated embodiment of the invention, the exercise mechanisms includes an overhead bar assembly indicated generally at 80 (See FIG. 3), an arm curl assembly indicated generally at 110 (See FIG. 4), a dip assembly indicated generally at 130 (See FIG. 5), a leg curl assembly indicated generally at 140 (See FIG. 6), and a fly assembly indicated generally at 160 (See FIG. 7). A resistance element is operatively connected with each exercise mechanism to resist movement of the exercise mechanism. In the embodiment shown, all of the exercise mechanisms except the fly assembly use a single magnetic particle break 180 as a resistance element. A main drive assembly 179 operatively connects each of the exercise mechanisms with the magnetic particle brake.

The main drive assembly 179, includes an output shaft 182 on which the magnetic particle brake is mounted along with a plurality of clutches 184, 186, 188, and 190. There is one clutch mechanism for each independent mechanism operatively connected with the particle brake 180. Each clutch is connected by a drive subassembly to one of the exercise mechanisms. In the illustrative embodiment, there are four drive subassemblies 192, 194, 196 and 198. Each exercise mechanism and its associated drive subassembly are described below.

Figure 3A:
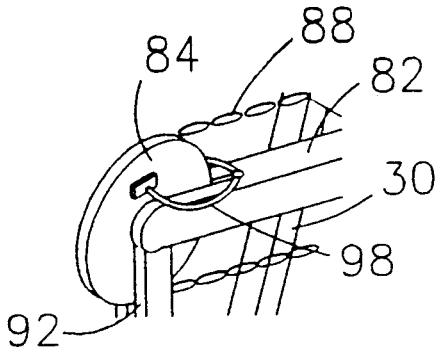
FIG. 3A is a fragmentary perspective view of the overhead bar assembly.
Figure 3B:
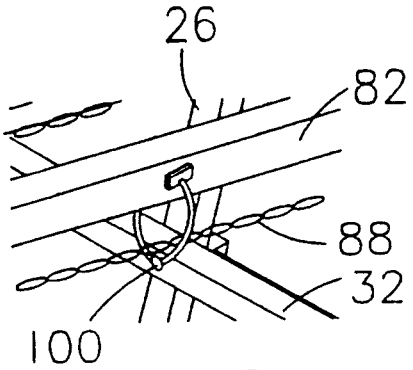
FIG. 3B is a section view of the overhead bar assembly.
Figure 3:
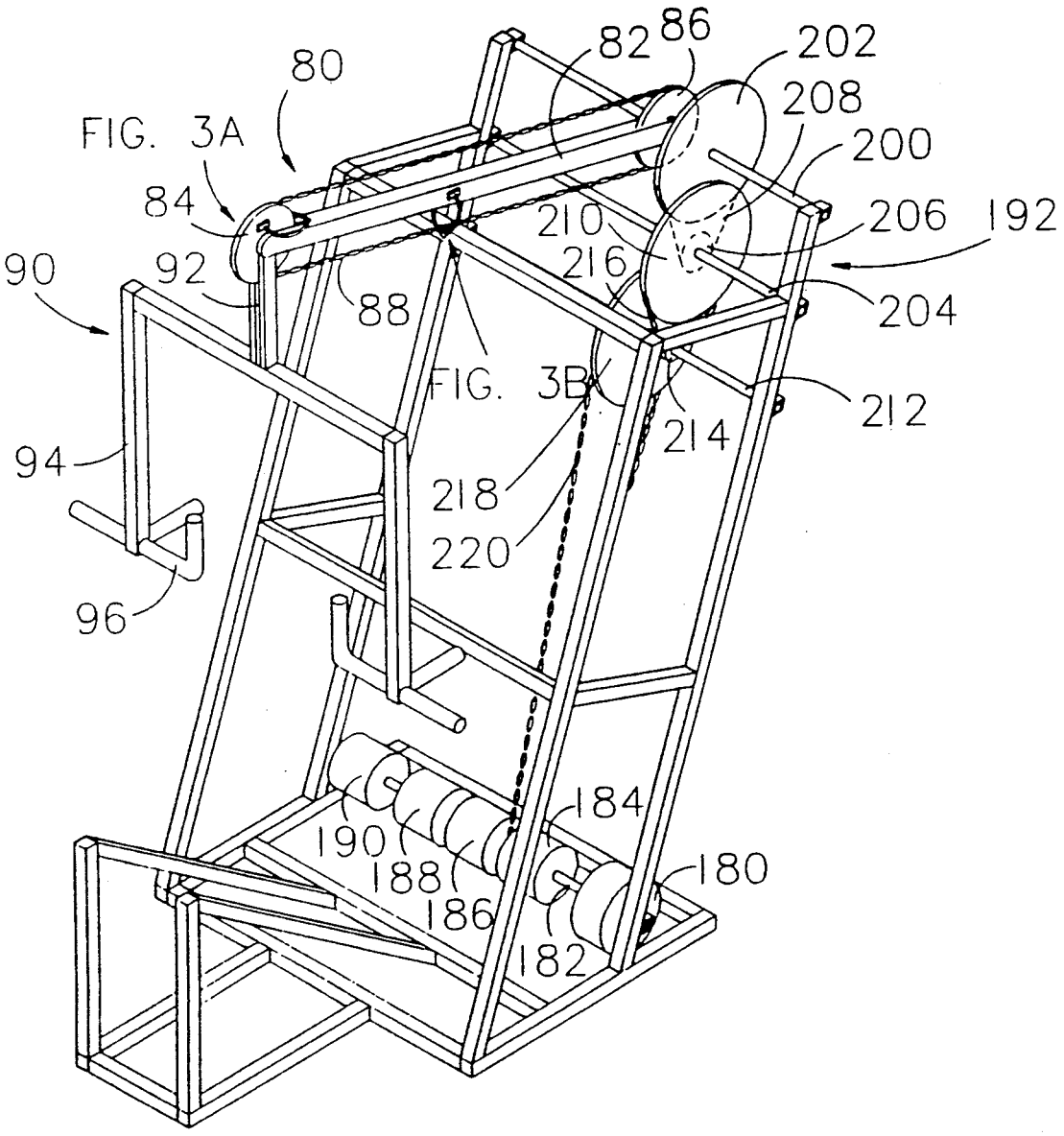
FIG. 3 is a perspective view illustrating the overhead bar assembly and its associated drive assembly.

Referring now to FIG. 3, the overhead bar assembly 80 and its associated drive subassembly 192 is shown. The overhead bar assembly 80 includes an overhead bar 82 rotatively mounted at one end to an input shaft 200. Overhead bar sprockets 84 and 86 are rotatably mounted at opposite ends of the overhead bar 82. A chain 88 is entrained around the overhead bar sprockets 84 and 86. A handle bar frame indicated generally at 90 is pivotally secured to one end of the overhead bar 82. The handle bar frame 90 includes a downwardly extending support member 92 and a U-shaped handle frame 94. Hand grips 96 are attached to the lower ends of the U-shaped handle frame 94. The handle bar frame 90 is fixedly secured to the sprocket 84 so that when the handle bar frame 90 is pivotally displaced about its horizontal axis, the sprocket 84 rotates with the handle bar frame 90. Sprocket 86 is keyed to the input shaft 200 so as to allow rotation with the input shaft 200.

A caliper brake 98 is mounted on the overhead bar and is adapted to engage sprocket 84 as shown in FIG. 3A. The function of the caliper breaker 98 is to lock the handle bar frame 94 in a fixed position relative to the overhead bar 82. A second caliper brake 100 shown in FIG. 3B, allows the overhead bar to be locked in a fixed position relative to the frame 12.

When the first caliper brake 98 is disengaged and the second caliper brake is engaged, the overhead bar assembly functions as a bench press. The user pushes outwardly against the U-shaped handle bar frame 90 which rotates pulley 84, which in turn drives sprocket 86. Alternatively, when the first caliper brake 98 is engaged and the second caliper brake 100 is disengaged, the overhead bar assembly functions as an overhead press. The user pushes upwardly against the handle bar frame 90, the overhead bar rotates about an axis extending through the input shaft 200.

The drive subassembly 192 transmits the rotation of the input shaft 200 to the output shaft 182.

The drive subassembly 192 includes, in addition to the input shaft 200, two counter shafts 204 and 212. The ends of the shafts 200 and 212 are all rotatively mounted in bearings attached to the rear support columns 24 and 26. A main drive sprocket 202 is mounted on the input shaft 200 and is connected by a chain 208 to a driven sprocket 206 on countershaft 204. A counter drive sprocket 210 is mounted on countershaft 204 and is connected by a chain 216 to a driven sprocket 214 on countershaft 212. A final counter sprocket 218 is mounted on countershaft 212 and connected by chain 220 to a clutch mechanism 184 mounted on the output shaft 182.

Figure 4:
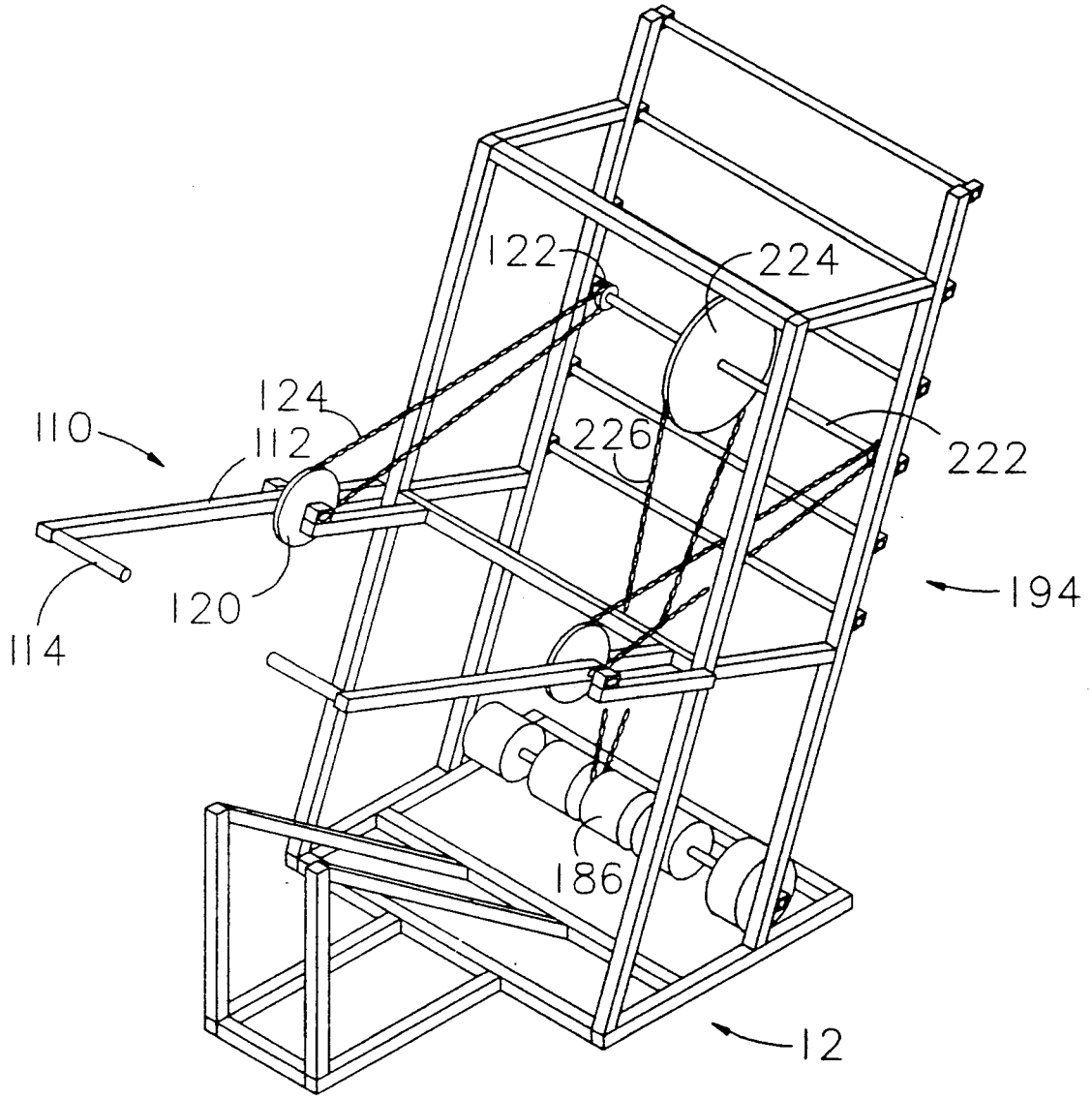
FIG. 4 is a perspective view of the arm curl assembly and its associated drive assembly.

Referring now to FIG. 4, the arm curl assembly is shown therein and indicated generally by the numeral 110. There are two arm curl assemblies 110. Only one arm curl assembly 110 is described herein, it being understood that the other arm curl assembly 110 is identical.

The arm curl assembly 110 includes an arm curl bar 112 having a hand grip 114 attached thereto. The opposite end of the arm curl bar 112 is fixedly secured to a sprocket 120 which is rotatively mounted between the support members 42 and 44. The sprocket 120 is connected by a chain 124 to a driven sprocket 122 mounted on the input drive shaft 222 which is rotatively mounted in bearings attached to the rear support columns 24 and 26. The arm curl bar 112 may, if desired, be jointed so as to enable the arm curl bars 112 to pivot inwardly and outwardly.

The drive subassembly 194 associated with the arm curl bar assembly 110 includes the input shaft 222. A main drive sprocket 224 is mounted on the input shaft 222 and is connected by a chain 226 to clutch 186.

To use the arm curl bar assembly 110, the user sits between the arm curl bars 112 and grasps the handles 114 in an underhanded manner. The arm curl bars are pivotally displaced about a horizontal axis by the user. As the bars 112 rotate upwardly, the sprockets 120 and chains 124 drive the sprockets 122, which in turn drives the input shaft 222. The main drive sprocket 224 and chain 226 drives the output drive shaft 182.

Figure 5:
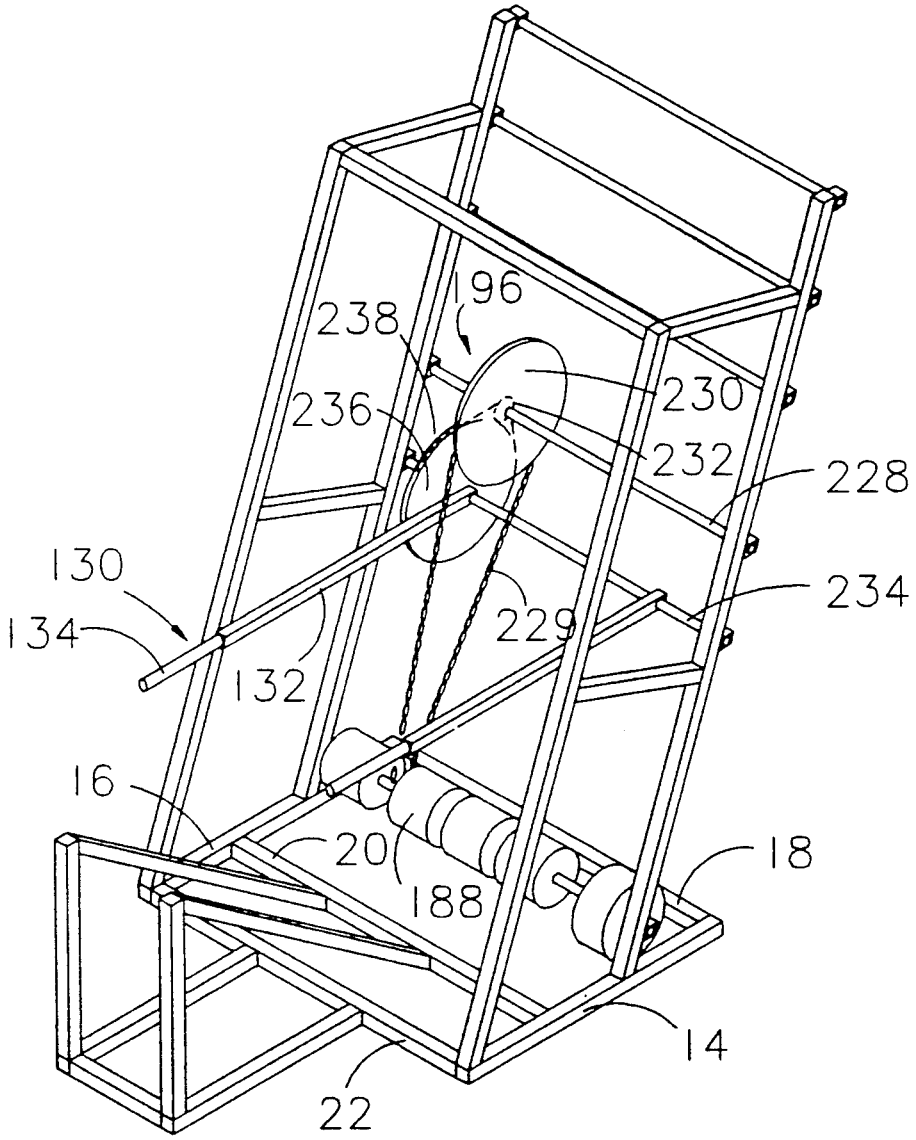
FIG. 5 is a perspective view of dip assembly and its associated drive assembly.

Referring now to FIG. 5, the dip assembly 130 and its associated drive sub-assembly 196 are shown. The dip assembly comprises two dip bars 132 having a hand grip 134 at one end thereof. Each dip bar 132 is fixedly secured to an input shaft 234 of the drive subassembly 196. A main drive sprocket 236 is mounted on the input shaft 234 and is connected by a chain 238 to a driven sprocket 232 on the counter shaft 228. A counter drive sprocket 230 is also mounted on the counter shaft 228 and is connected by a chain 229 to clutch 188.

To use the dip assembly, the user assumes a sitting position between the dip bars 32 and pulls upwardly on the dip bars 132. The rotation of the dip bars 132 drives the input shaft 234 on the drive subassembly 196 which in turn causes the output shaft 182 to rotate.

Referring now to FIG. 6, the leg curl assembly 140 is shown therein. The leg curl assembly includes a leg curl bar 142 having two padded foot bars 144 affixed to one end thereof. The opposite end of the leg curl bar 142 is pivotally connected to a first support member 146 which is, in turn, fixedly connected to a second support member 147. The second support member 147 is rotatably connected to the input shaft 246 of the drive subassembly 198. A cylinder (not shown) allows the support member 147 to be raised and lowered into the proper position for the user.

A first sprocket 148 is rotatably mounted to the support bar 146 and is fixedly secured to the leg curl bar 142. A pair of second sprockets 150 and 151 are rotatably mounted at the juncture of the first and second support members 146 and 147. A final sprocket 154 is fixedly mounted on the input shaft 246. The intermediate sprocket 150 is connected by a chain 152 to the first sprocket 148. The intermediate sprocket 151 is connected by chain 156 to the main drive sprocket 154 on the input shaft 246. Thus, when the leg curl bar 142 is pivotally displaced about its axis, the input shaft 246 is rotated.

The drive subassembly 198 includes the input drive shaft 246 having a drive sprocket 248 mounted thereon. The input drive shaft 246 is rotatively mounted in bearings attached to the forward columns 28 and 30. The drive subassembly 198 also includes a counter shaft 240 having a driven sprocket 244 mounted thereon and connected to the main drive sprocket 248 by a chain 250. A counter drive sprocket 242 is also mounted on the counter shaft 240 and is connected by a chain 252 to the clutch 188 which is mounted on the output drive shaft 182.

In use, the user sits on the seat and hooks his or her feet underneath the foot bar 144. The leg curl bar is raised by straightening the legs at the knees and is lowered by bending the knees. As the leg curl bar 142 is raised and lowered, the sprocket 148 is rotated which in turn causes sprockets 150 and 154 to rotate. Sprocket 154 drives the input drive shaft 246 of the drive subassembly 198 which in turn causes the output shaft 182 to rotate.

Referring now to FIG. 7, the fly assembly 160 is shown. The fly-assembly includes two parallel mounting plates 162 and 164. The lower mounting plate 162 is secured by weldment to the frame 12. A pair of fly bars 166 are mounted on shafts 168 which extend through the lower plate 162. Arm brackets 170 and hand grips 172 are connected to the end of each fly bar 166.

The fly bars 166 are pivotal displaced about their respective shafts 168. Each shaft 168 is connected to a sprocket 260 rotatively mounted between the mounting plates 162 and 164. The sprockets 260 are connected by chains 262 to smaller driven sprockets 264. The driven sprockets 264 are coupled with two counter-rotating gears 266 which are meshed with one another. One of the counter-rotating gears 266 has a shaft 268 which extends through the upper mounting plate 164 and is coupled to a gear box 270 and particle brake 272. The particle brake 272 provides resistance solely for the fly assembly 160.

The resistance for all the exercise mechanisms, except the fly assembly 160, is provided by the magnetic particle brake 80 which resists rotation of the output shaft. A suitable brake 80 is manufactured by Warner Electric and designated the model PSB-240. The clutch mechanisms 184–190 permit any one of the exercise mechanisms to be independently operated. Suitable clutches are also made by Warner Electric and designated the model ATC 25. The clutch mechanisms 184–190 are preferably controlled by a microprocessor (not shown) which turns the clutch mechanisms on and off depending on the exercise selected by the user. During any give exercise, only one clutch mechanism is engaged.

The microprocessor may also control the actuation of the caliper brakes 98 and 100 by means of an electric solenoid (not shown). Additionally, the microprocessor may also control the amount of resistance provided by the electronic brake 80 from 0 lbs to approximately 200 lbs. Since microprocessor controls are well-known to those skilled in the art, further detailed description of such controls is not deemed necessary.

While the present invention is particularly designed for handicapped or other physically limited persons, it will be appreciated that able-bodied persons may also use the exercise machine of the present invention. In this regard, the present invention has the advantage over prior art machines requiring only a small space. Thus, the present invention may be used in small health clubs or homes where there is insufficient space for multiple machines.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. An exercise device comprising:

(a) a frame having a seat;

(b) a plurality of exercise mechanisms mounted on the frame and adapted to be displaced by a user to perform exercise, wherein all of said exercise mechanisms are operable from said seat;

(c) a brake mechanism for providing resistance against movement of the exercise mechanisms;

(d) a drive assembly operatively connected between the brake mechanism and a plurality of said exercise mechanisms so that the exercise mechanisms can be independently manipulated by the user, said drive assembly comprising:

(1) a main drive shaft mounted on the flame for driving the brake mechanism;

(2) a plurality of clutch mechanisms mounted on the main drive shaft; and (3) and a drive sub-assembly operatively connecting each exercise mechanism to a respective clutch mechanism, each drive subassembly including an input shaft rotatively mounted on said frame and driven by a respective exercise mechanism, a countershaft rotatably mounted on said frame, a first gear means coupling said input shaft with said countershaft, and a second gear means coupling said countershaft with said main drive shaft through its respective clutch.

2. The exercise machine according to claim 1 wherein a plurality of said input shafts and countershafts are vertically spaced on said frame.

3. The exercise machine according to claim 1 wherein said plurality of exercise mechanisms include an overhead bar assembly.

4. The exercise machine according to claim 1 wherein said plurality of exercise mechanisms include an arm curl assembly.

5. The exercise machine according to claim 1 wherein said plurality of exercise mechanisms include a dip assembly.

6. The exercise machine according to claim 1 wherein said plurality of exercise mechanisms include a leg curl assembly.

7. An exercise device operable as a bench press and an overhead press comprising:

(a) a frame having a seat;

(b) an overhead bar mounted on the frame so as to extend over the seat, wherein the overhead bar is pivotable about a substantially horizontal first axis;

(c) a handle bar frame pivotally secured at one end of the overhead bar so as to pivot about a substantially horizontal second axis, said hadle bar frame being operable by a person seated in said seat;

(d) a particle brake for selectively locking the overhead bar in fixed position relative to the frame while the user pivotally displaces the handle bar frame about the second axis;

(e) means for selectively locking the handle bar frame in a fixed position relative to the overhead bar while the user pivotally displaces the overhead bar about the first axis;

(f) resistance means operatively connected to the handle bar frame and overhead bar for providing resistance to the pivotal displacement of the overhead bar and/or handle bar frame; and (g) a main drive assembly operatively connecting the overhead bar and handle bar frame to the particle brake; the main drive assembly including:

(1) a main drive shaft rotatively mounted on the frame, said particle brake being mounted on the main drive shaft;

(2) a one-way clutch mechanism mounted on the main drive shaft; and (3) a reduction means interconnecting the overhead bar and handle bar frame to said clutch mechanism.

8. The exercise device according to claim 7 wherein the reduction means comprises an input drive shaft rotatively mounted to the frame and operatively connected to both the overhead bar and handle bar frame so as to rotate when either the overhead bar or handle bar frame is pivotally displaced; at least one countershaft rotatively mounted on the frame; means operatively connecting the countershaft to the input shaft so that the countershaft rotates with the input shaft; and means operatively connecting the countershaft to the main drive shaft so that the main drive shaft rotates with the countershaft.

9. The exercise device according to claim 8 wherein the means operatively connecting the input shaft to the countershaft includes a drive sprocket mounted on the input shaft, a driven sprocket on the countershaft, and an endless carrier entrained around both the drive sprocket and driven sprocket.

* * * * *